United States Patent [19]

Looney et al.

[11] 4,096,042

[45] Jun. 20, 1978

[54] ELECTROPLATING METHOD AND APPARATUS

[75] Inventors: Robert B. Looney, Aiken; William E. L. Smith, North Augusta, both of S.C.

[73] Assignee: The United States of America as represented by the United States Department of Energy, Washington, D.C.

[21] Appl. No.: 814,894

[22] Filed: Apr. 4, 1969

[51] Int. Cl.[2] ..... C25D 3/12

[52] U.S. Cl. ..... 204/1.5; 204/26; 204/194; 204/225

[58] Field of Search ..... 204/26, 194, 225, 222

[56] References Cited

U.S. PATENT DOCUMENTS

| | | | |
|---|---|---|---|
| 902,892 | 11/1908 | Lutz | 204/26 |
| 1,322,408 | 11/1919 | Chandler | 204/26 |
| 1,772,074 | 8/1930 | Engelhardt et al. | 204/26 |
| 1,886,218 | 11/1932 | Olin et al. | 204/26 |
| 3,065,153 | 11/1962 | Hough et al. | 204/26 |
| 3,249,520 | 5/1966 | Hermann | 204/26 |

FOREIGN PATENT DOCUMENTS

| | | | |
|---|---|---|---|
| 490 of | 1897 | United Kingdom | 204/26 |

*Primary Examiner*—Leland A. Sebastian
*Attorney, Agent, or Firm*—Dean E. Carlson; Allen F. Westerdahl

[57] ABSTRACT

An apparatus for high speed electroplating or anodizing tubular members such as nuclear reactor fuel elements. A loading arm positions the member on a base for subsequent support by one of two sets of electrical contacts. A carriage assembly positions electrodes into and around the member. Electrolyte is pumped between the electrodes and the member while electric current is applied. Programmed controls sequentially employ each of the two sets of contacts to expose all surfaces of the member to the electrolyte. The member is removed from the apparatus by an unloading arm.

7 Claims, 4 Drawing Figures

ELECTROPLATING METHOD AND APPARATUS

BACKGROUND OF THE INVENTION

This invention was made in the course of or under a contract with the United States Atomic Energy Commission.

FIELD OF THE INVENTION

This invention relates generally to the electroprocessing of a workpiece. For purposes of this application "electroprocessing" includes electroplating, anodizing, or etching by electrochemical action. More particularly, the invention pertains to an improved apparatus for electroplating tubular fuel or target elements for use in nuclear reactors.

Nuclear fuel and target elements are generally clad with aluminum, stainless steel, or other materials to prevent corrosion of the core material by the reactor coolant or moderator fluid. Often the fluid is ordinary or heavy water. Tubular, aluminum clad fuel elements are frequently employed in isotope production reactors where neutron economy is an important consideration. Aluminum has a low cross section for neutron absorption but a relatively low melting point. A tubular configuration can provide sufficient cooling area to prevent melting during normal operation. However, the nuclear fuel along with the fission products may diffuse through the protective layer of cladding and contaminate the coolant or moderator. A thin coat of nickel can be electroplated on the fuel to provide a base for the cladding and to act as a diffusion barrier. Nickel is a neutron absorber and therefore a minimum quantity should be used. A thin, but impervious nickel coating covering the entire surface of the nuclear fuel element is thus required.

DESCRIPTION OF PRIOR ART

Heretofore, a number of apparatus for electroplating tubular members on both the internal and external surfaces have been described in the prior art. Hough et al. U.S. Pat. No. 3,065,153 describes an apparatus including an inner anode for inserting into a tubular member and an outer anode for encompassing the member. Electrolyte is pumped through the annular spaces between the anodes and the tubular member while electroplating current is passed between the anodes and the member.

The prior art, however, has several disadvantages which renders it unsuitable, particularly for electroplating nuclear fuel elements. A permanent electrical connection to the member is required during the entire electroplating process. Consequently, the surface area beneath the connection is not plated. Spacers or masking rings are also used to hold the tubular member in position during electrolysis. Similarly, the surfaces of the tubular member covered by these spacers are either not electroplated or are electroplated to a reduced thickness. To electroplate beneath the spacers to a satisfactory thickness, excess nickel must be deposited on the exposed surfaces of the tubular member. The excess nickel would be detrimental to neutron economy in a nuclear reactor.

Another disadvantage is that the prior art apparatus must be manually disassembled after each tubular member has been electroplated and then subsequently reassembled with a new member. The anodes and the member are generally bolted together on a base adapted to admit electrolyte or in an electrolyte bath. The electrical connections are conventionally made and must be disconnected and replaced when the completed tubular member is removed and a new member installed. Furthermore, electrolyte remaining in the apparatus may delay the disassembly and reassembly. Thus, the total time required to electroplate a single member is considerably more than the actual time required for electrolysis.

SUMMARY OF THE INVENTION

It is therefore, an object of the present invention to provide an apparatus and method for electroprocessing the entire surface of a workpiece.

It is a further object to provide an improved apparatus for electroplating the entire surface of a tubular nuclear fuel element with a uniformly thick, impervious coating.

In accordance with the present invention, there is provided an electroprocessing apparatus and method including the circulation of electrolyte between a workpiece and electrodes. A first set of electrical contacts having such as oppositely disposed groups of contact pins are forced against point locations on opposite surfaces of the workpiece to provide support and maintain the workpiece at opposite polarity to the electrodes. A similar second set of electrical contacts are coaxially aligned but angularly displaced from the first set of electrical contacts. The two sets of contacts are programed to sequentially engage the workpiece to expose the entire surface thereof to the electrolyte during electrolysis.

BRIEF DESCRIPTION OF DRAWINGS

The preferred embodiment of the present invention is illustrated in the following drawings wherein.

DESCRIPTION OF THE PREFERRED EMBODIMENT

Figures 1, 2:
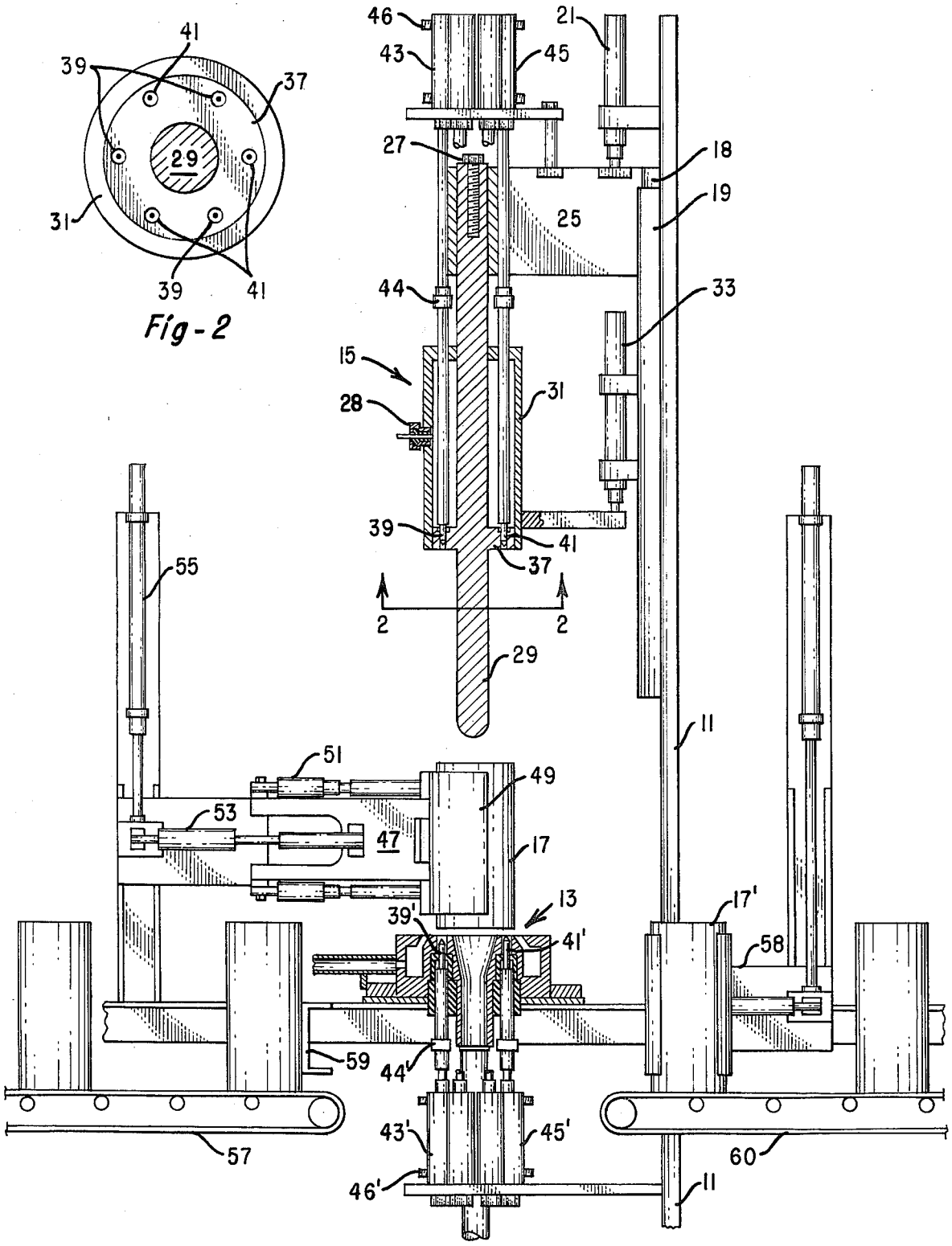
FIG. 1 is an elevation view partially in cross section of an apparatus for electroprocessing tubular members.
FIG. 2 is an enlarged cross section taken along line 2—2 of FIG. 1 showing the relative positions of the contacts and electrodes.

Referring now to FIGS. 1 and 2, an apparatus is shown including a moveable carriage assembly 15 and base assembly 13 supported by a stationary frame 11. The carriage assembly 15 is supported on a slide plate 18 slidably fitted within a guide or channel 19. A fluid activated cylinder 21 mounted on frame 11 has a longitudinally movable piston suitably attached to the carriage 15 by a plate or connecting member 25. Operation of cylinder 21 imparts a linear reciprocal movement to carriage assembly 15. The carriage is shown in the raised or transfer position for receiving a new workpiece or tubular member 17 and for removing an electroprocessed member 17'. A slide stop (not shown) can be provided within guide 19 to support the carriage assembly 15 in the lowered or operating position.

An inner or elongated electrode 29 is mounted to extend from the lower portion of the carriage assembly 15 and is adapted to move with the carriage assembly 15 to a location proximate base assembly 13.

An outer or tubular electrode 31 is disposed coaxially around the elongated electrode 29 on the carriage assembly. Both electrodes 29 and 31 are electrically connected to a source of electrical potential at terminals 27 and 28 respectively. A second fluid activated cylinder 33 is mounted on the carriage slide plate 18 and has a movable piston suitably attached to tubular electrode 31 to move it longitudinally relative to the elongated electrode 29 and the base assembly 13.

Suitable transfer equipment is provided to handle the tubular members entering the leaving the electroprocessing portion of the apparatus. A loading arm 47 includes a gripper 49 for seizing a tubular member 17. The grippers 49 may be pivoted and tightened around the member 17 by fluid activated cylinders 51. Other fluid activated cylinders 53 and 55 are provided to move arm 47 laterally and vertically respectively along suitable slides to position tubular member 17 above base assembly 13. An input conveyor 57 delivers tubular members to within range of the loading arm 47. A stop 59 is provided at the end of conveyor 57 to locate the tubular member for approach by the loading arm 47. A switch (not shown) is provided on stop 59 to deenergize input conveyor 57 when a tubular member arrives and prevent pile up. A similarly operated unloading arm 58 is shown removing a member 17' from the base assembly 13 and transferring it to the output conveyor 60.

A first set of movable electrical contacts includes at least three equally spaced and downwardly facing points or pins 39 (see FIG. 2) and at least three equally spaced and upwardly facing pins 39'. Separate fluid activated cylinders 43 and 43' mounted on the carriage assembly 15 and base assembly 13 respectively support and force bias each pin. Cylinders 43 and 43' are provided with suitable fittings such as those shown at 46 and 46' for admitting and venting operation fluid to extend or retract each pin in relation to tubular member 17. Each pin can thereby be individually driven with equal force against point locations on the surface of the tubular member 17. The pins are preferably sized to leave a maximum surface exposed for electroprocessing and yet provide stable support and sufficient electrical contact.

Although a single cylinder can be employed to force bias each group of three similarly aligned pins 39, 39', it is preferable to provide a separate cylinder for each pin. A single cylinder operating a plurality of contact pins can unequally force the individual pins against the member and producing arcing. If arcing should occur at a loose connection, portions of the pin can be burned away to aggravate the defective connection producing the arc.

A second set of contact points or pins 41 and 41' are axially aligned but angularly displaced from the first set of pins. The second set of pins are similarly mounted on fluid activated cylinders 45, 45' located on the carriage and base assemblies respectively. Likewise, cylinders 45 and 45' are operated in a manner similar to that of cylinders 43 and 43'. The contact pins of both sets are connected to a source of electrical potential at suitable electrical terminals such as those shown at 44 and 44'. The pins are maintained at opposite electrical polarity to electrodes 29 and 31 while contacting member 17. Either set of pins may be extended to support and contact the member while the other set is retracted for electroprocessing of point locations on the surface area aligned with the retracted pins.

Figure 3:
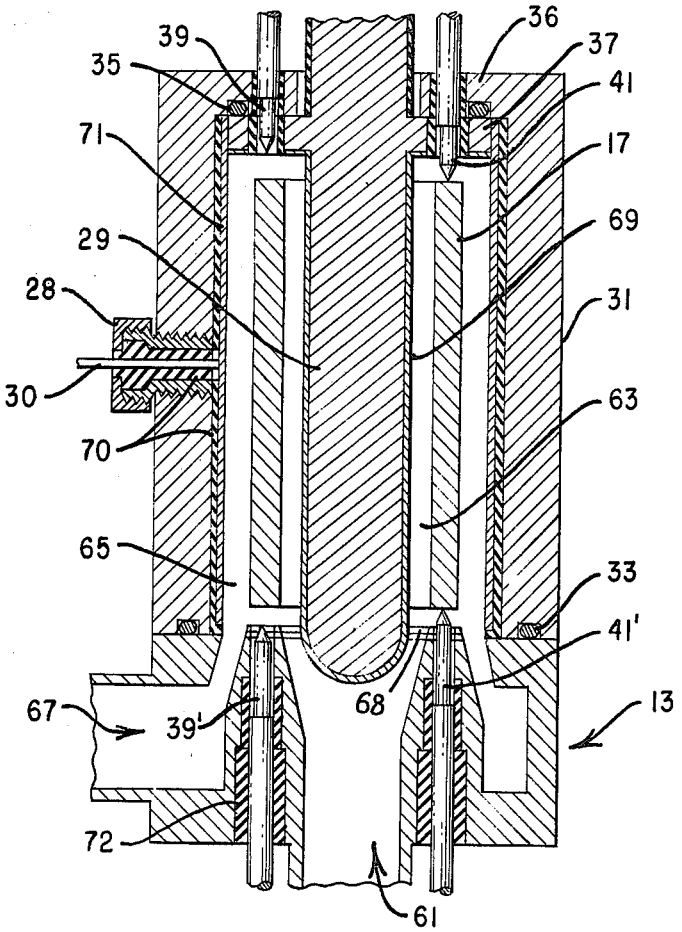
FIG. 3 is an enlarged fragmentary cross section of a portion of the present apparatus showing the tubular member and electrodes in position for electroprocessing.

A portion of the present apparatus is shown in the operating position in FIG. 3. The tubular member 17 is supported slightly above base assembly 13 by the second set of contact pins 41 and 41' while the first set of pins 39 and 39' are retracted. Elongated electrode 29 penetrates member 17 to form an inner annular passageway 63. An outer annular passageway 65 is formed by lowering tubular electrode 31 over and around tubular member 17 until the electrode 31 contacts base assembly 13.

Electrode 29 is provided with an outwardly extending flange 37 disposed above the electrode portion that penetrates member 17. Electrode 31 has an inwardly extending flange 36 for overlapping flange 37 when the electrodes are in the operating position. A sealing ring 35 placed between overlapping flanges 36 and 37 prevents electrolyte leakage. A second sealing ring 33 seals the interface between tubular electrode 31 and base assembly 13.

Platinum layers 69 and 71 cover the outer surface of electrode 29 and the inner surface of electrode 31 respectively to facilitate electroprocessing. Layer 69 extends laterally over Flange 37 to provide an anode or electrode surface aligned opposite to the upper end face of member 17. An annular disk member 68 is disposed in base assembly 13 to provide a similar electrode surface aligned opposite to the bottom end face of member 17. An electrical lead 30 is held against layer 71 by connector 28 to maintain that platinum layer at a suitable electrical potential for electrolysis. Another similar electrical lead (not shown) maintains annular member 68 at the same electrical polarity as layers 69 and 71. Electrical linkage to layer 69 is provided by the metal core portion of electrode 29. Electrical insulation 70 separates the platinum 71 and the electrical conductor 30 from the remainder of electrode 31. Further suitable electrical insulation such as that shown at 72 separates the contact pins 39, 39', 41 and 41' from surrounding metal parts to prevent short circuiting.

The spacing between tubular member 17 and base assembly 13 is minimized to limit electrolyte flow beneath the tubular member. Some flow, however, is necessary to electroprocess the bottom face of tubular member 17. A significantly larger spacing is provided between tubular member 17 and flange 37 to interconnect the inner and outer annular passageways 63 and 65. An electrolyte entrance port 61 communicates with inner passageway 63 and an electrolyte discharge port 67 communicates with outer passageway 65 to allow series circulation of electrolyte through the annular passageways.

During electrolysis, electrodes 29 and 31 are maintained at one electrical potential while member 17 is maintained at a different electrical potential. If electroplating is desired, member 17 is made the cathode and the electrodes 29 and 31 as well as member 68 become anodes. The polarity is reversed for etching or anodizing. The width of the inner annular passageway 63 and outer annular passageway 65 should be equal and constant throughout the length of the tubular member to provide uniform electroprocessing. Merely by way of example, about 0.5 centimeter wide annular passageways have been found to be satisfactory in the electroplating of about 10 centimeter diameter members.

The flow of electrolyte through annular passageways 63 and 65 must be at a sufficient rate to sweep away gas formation resulting from electrolysis. Trapped or slow moving gases adjacent the member 17 surface can cause nonuniform thickness in the electroplating. Furthermore, the electrolyte concentration should not drop significantly as it flows through the annular passageways. Although specific values are not critical, it has been found that an average linear velocity of about 1.8 meters per second in the inner and outer passageways or about 150 liters per minute is suitable for electroplating the above described member penetrated by a 6.6 centimeter diameter elongated electrode 29 and surrounded by a 11 centimeter inside diameter tubular electrode 31.

Figure 4:
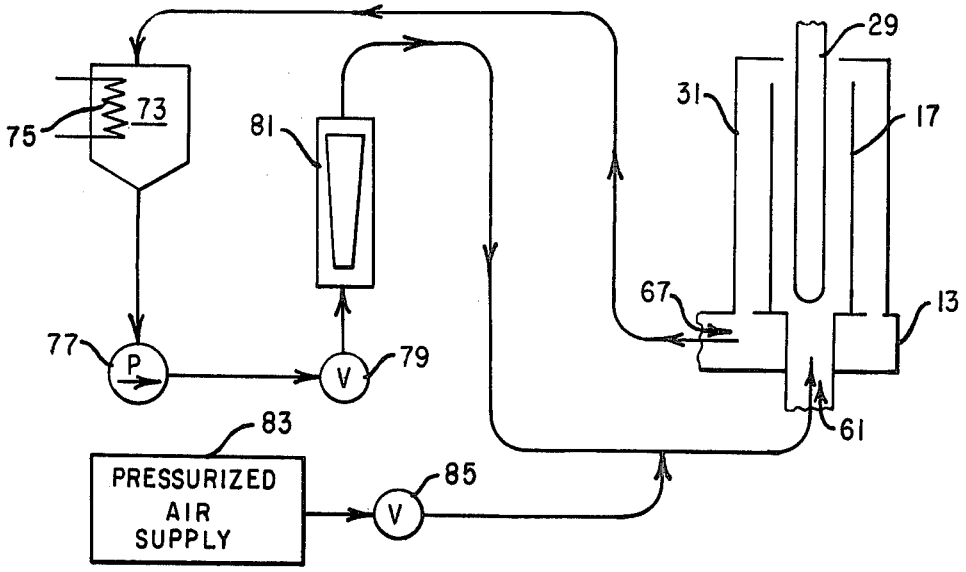
FIG. 4 is a schematic drawing illustrating the electrolyte flow system of the present invention.

FIG. 4 shows a schematic drawing of an electrolyte circulation system. A reservoir 73 is provided for storing and preparing the electrolyte. For nickel plating, a modified Watts bath solution containing about 220 to 340 grams per liter of $NiSO_4.6H_2O$, 22 to 45 grams per liter of $NiCl_2.6H_2O$, and about 30 to 45 grams per liter of boric acid dissolved in aqueous solution can be used. The pH is adjusted to about 1.9 to 2.4 by addition of nickel carbonate or sulphuric acid. A heater 75 is provided within reservoir 73 to maintain the electrolyte at about 48° C to 52° C during electrolysis.

The electrolyte solution is circulated with a suitable pump 77 through a valve 79 and flow meter 81 into port 61 of the base assembly 13. The solution returns to reservoir 73 through port 67. A pressurized air supply 83 is connected through valve 85 to the conduit supplying electrolyte into port 61. When electrolysis is completed, air or another suitable gas may be used to expel the electrolyte from the annular passageways around and within the tubular member 17. Withdrawal of the electrodes 29 and 31 and removal of the member 17 may then proceed without unnecessary delay.

The operating cycle of the present apparatus may be controlled by a cyclic timer device such as a stepping drum programmer containing a plurality of electrical switches. The electrical switches are operated by the programmer to open or close in a suitable sequence and at suitable intervals within the timer cycle. The programmer is sequenced by limit and pressure switches which sense when each step of the cycle is completed. Each electrical switch operated by the programmer energizes a control device for operating a component in the electroprocessing apparatus. For example, solenoid valves can be operated by the programmer to admit or vent hydraulic (or pneumatic) fluid into the loading arm cylinders (see reference numerals 51, 53 and 55 in FIG. 1). A similar arrangement can be provided for the other components linked to fluid activated cylinders (e.g., the carriage assembly 15, the first and second sets of contact pins 39 and 41, the tubular electrode 31 and the unloading arm 58). Also, the programmer can operate other control devices to connect the electrodes 29 and 31 and contact pins 39 and 41 to a source of D.C. voltage at opposite polarity for electroprocessing the workpiece.

The operating sequence for the apparatus can proceed as follows. The loading arm 47 picks up a tubular member 17 from the input conveyor 57 and positions it over the base assembly 13. The carriage assembly 15 slides downward to insert the elongated electrode 29 into the tubular member 17. The three pins 39 of the first set of contacts in the carriage assembly are driven downward into the top end face of the tubular member 17 while the corresponding three pins 39' in the base assembly are driven upwards. The tubular member 17 is thereby supported and electrically contacted by the first set of pins 39 and 39'. The loading arm 47 then releases the tubular member 17 and moves away. The tubular electrode 31 slides downward to seal against the base assembly 13 and flange 37 on the elongated electrode 29. Electrolyte is circulated through the annular passageways 63 and 65 between the member 17 and electrodes 29 and 31. Electrodes 29 and 31 and member 17 are next maintained at different electrical potential to electroplate, etch, or anodize the member as required. For nickel plating a sufficient potential difference is maintained to produce a current density of about 5000–10,000 amp/$m^2$ of cathode area.

When electroplating a reactive metal such as a uranium surface with nickel, it is important to coat a thin initial layer of metal on the member 17 held by the first set of contacts 39 and 39' and then engage the second set of contacts 41 and 41' onto a protected electroplated surface. About five seconds of initial electroplating have been found to provide a sufficient protective film. A longer period of initial electrolysis may corrode the bare surface of member 17 beneath the first set of contacts 39 and 39'. After the initial electroplating period, the process is continued for a second period, for example about 25 seconds, with contacts 41 and 41' engaged to coat the member 17 surface including the point locations initially covered by the first set of contacts 39 and 39'. The contacts are again interchanged and electroplating continued for a final period, for example abouut 20 seconds, while again supporting the member 17 with the first set of contacts 39 and 39'. Each set of contacts is utilized for an equal interval of time to electroplate an equal thickness over each point location. The contacts are cleaned during each disengagement by reversing the contact polarity. This reversal in contact polarity also provides additional anode surface to uniformly plate the end faces of member 17. After sufficient electrolysis the electrical potential difference is discontinued and the electrolyte flow stopped. The electrolye is then blown out of the apparatus by air pressure through valve 85 (about 1 kg. per $cm^2$ for about 2 seconds).

After the electrolyte is expelled, tubular electrode 31 is raised and unloading arm 58 seizes member 17. The contacts holding member 17 are retracted and the carriage assembly raised to withdraw the elongated electrode 29 from the member 17. The member 17 is finally transported to the output conveyor 60 by the unloading arm 58.

Although the invention is described in detail with reference to electroplating a tubular member, it should be clear that with suitable modifications an oxide or other protective coating can be anodized onto the member. Etching may likewise be performed with appropriate modifications known to those skilled in the art. Workpieces of other than tubular configuration may also be electroprocessed with suitable changes to the apparatus and method. It will be understood that various other changes may be made in the details of the preferred embodiment described herein, by those skilled in the art, within the scope of the invention as expressed in the appended claims.

What is claimed is:

1. In an apparatus for electroplating all surfaces of a tubular workpiece including a tubular anode for encompassing said workpiece and an elongated anode for penetrating said workpiece, and means for circulating electrolyte between said workpiece and said anodes, the improvement comprising:

(a) a support frame including a base assembly;

(b) a carriage assembly supported on said frame and adapted for linear reciprocal movement relative to said base assembly, said tubular and elongated anodes being supported in coaxial alignment by said carriage assembly with said tubular anode being movable along the axis of said elongated anode, said elongated anode and said base assembly including laterally extending anode surfaces for aligning in spaced facing relationship to the opposite end faces of said tubular workpiece;

(c) first contact means cooperatively supported by said carriage assembly and said base assembly for fixedly supporting and electrically maintaining said workpiece as a cathode;

(d) second contact means cooperatively supported by said carriage assembly and said base assembly in spaced relationship relative to said first contact means for fixedly supporting and electrically maintaining said workpiece as a cathode;

(e) means for alternately engaging said first and then said second contact means with said workpiece;

(f) means for moving said carriage assembly away from said base assembly to position said workpiece in coaxial alignment with said anodes, and for moving said carriage assembly towards said base assembly to position said elongated anode into said tubular workpiece in spaced relationshp to define an inner annular passageway; and (g) means for longitudinally positioning said tubular anode around said workpiece to define an outer annular passageway, said tubular anode sealingly communicating with said elongated anode to interconnect said inner and outer passageways for the circulation of electrolyte.

2. The apparatus of claim 1 wherein both said first and said second contact means includes at least two cooperating groups of contact pins slidably supported by said base assembly and said carriage assembly respectively, each pin being individually supported by a force biasing means for extending and retracting said pin in relation to said tubular member.

3. The apparatus of claim 2 wherein each of said first and said second contact means comprise two oppositely facing groups of three contact pins for pressing against opposite end surfaces of said tubular member.

4. The apparatus of claim 1 wherein transfer means are provided for positioning said tubular workpiece between said base and carriage assemblies and for removing said tubular workpiece therefrom after electrolysis.

5. The apparatus according to claim 1 wherein means are provided for purging residual electrolyte from said annular passageways.

6. A method of electroplating a workpiece disposed between at least two anodes comprising:

(a) engaging a first group of point locations on the surface of said workpiece during an initial time interval of no more than about 5 seconds duration with a first set of cathodically biased contacts for fixedly supporting and electrically contacting said workpiece;

(b) maintaining said workpiece in a fixed location while passing electrolyte between said workpiece and said anodes for said initial time interval to electroplate a film over exposed surfaces of said workpiece;

(c) engaging a second group of point locations on the surface of said workpiece with a second set of cathodically biased contacts disposed in spaced relationship to said first set of contacts followed by immediately disengaging said first set of contacts;

(d) maintaining said workpiece in a fixed location with engagement of said second group of point locations for a second time interval of substantially longer duration than said first time interval to electroplate exposed surfaces of said workpiece including said first group of point locations;

(e) reengaging said first group of point locations with said first set of contacts followed by immediately disengaging said second set of contacts; and (f) maintaining said workpiece in a fixed location with engagement of said second group of point locations for a third time interval of substantially longer duration than said first time interval to complete the electroplating of exposed surfaces of said workpiece including said second group of point locations, said third time interval being about equal to the duration by which said second time interval exceeds said first time interval.

7. The electroplating method of claim 6 wherein said workpiece includes a nuclear fuel and said electrolyte includes nickel ions.

* * * * *